US006850142B2

(12) United States Patent
Saito et al.

(10) Patent No.: US 6,850,142 B2
(45) Date of Patent: Feb. 1, 2005

(54) SURFACE MOUNTING TYPE COIL

(75) Inventors: Hideaki Saito, Tsurugashima (JP); Shinkichi Shimakage, Tsurugashima (JP); Hitoshi Sasanuma, Tsurugashima (JP)

(73) Assignee: Toko Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/643,873

(22) Filed: Aug. 20, 2003

(65) Prior Publication Data

US 2004/0066265 A1 Apr. 8, 2004

Related U.S. Application Data

(62) Division of application No. 09/768,063, filed on Jan. 24, 2001, now Pat. No. 6,633,218.

(30) Foreign Application Priority Data

Jan. 24, 2000 (JP) ..... 2000-13854
Jan. 24, 2000 (JP) ..... 2000-13855

(51) Int. Cl.[7] ..... H01F 27/02

(52) U.S. Cl. ..... 336/192; 336/83; 336/90; 336/200

(58) Field of Search ..... 336/65, 83, 90–96, 336/183, 192, 200, 212, 229, 232

(56) References Cited

U.S. PATENT DOCUMENTS 5,751,203 A 5/1998 Tsutsumi et al. ..... 336/65
6,154,112 A 11/2000 Aoba et al. ..... 336/192

FOREIGN PATENT DOCUMENTS

| | | | |
|---|---|---|---|
| JP | 5-190369 | | 7/1993 |
| JP | 07-161535 | * | 6/1995 |
| JP | 08-78245 | * | 3/1996 |
| JP | 11-233351 | * | 8/1999 |

* cited by examiner

*Primary Examiner*—Tuyen T. Nguyen

(57) ABSTRACT

A surface mounting type coil includes: a coil hiving windings which are wound around a magnetic core having a hole; a cylindrical magnetic body which is provided around the coil; and a plurality of metal plate terminals which leads of the windings are connected to; the metal plate terminals extending along an outer face of the cylindrical magnetic body from a bottom face to a top face thereof, and being secured to the cylindrical magnetic body in such a manner that tips of the metal plate terminals are within the thickness of the cylindrical magnetic body.

6 Claims, 3 Drawing Sheets

SURFACE MOUNTING TYPE COIL

This application is a division of 09/768,063, filed Jan. 24, 2001, now U.S. Pat. No. 6,633,218.

BACKGROUND OF THE INVENTION

1. Field of the Invention

The present invention relates to a surface mounting type coil, and more particularly relates to the surface mounting type coil which is used in a noise elimination filter of an interface in an LAN (Local Area Network), or a communication between computers or terminals and the like.

2. Description of the Related Art

FIGS. 11 and 12 show examples of this type of surface mounting type coil.

FIG. 11 is a perspective view of a conventional surface mounting type coil comprising a toroidal core. Windings 63 comprise a primary winding and a secondary winding, and are wound around a toroidal core 61. A plurality of external terminals 65 function as terminals for binding ends of the windings and terminals for external connection, and are provided on a base 62. The binding leads 66 of the windings 63 are bound and soldered to the external terminals 65.

Recently, there is a strong demand to reduce noise emission and interference. This type of surface mounting type coil has a problem of magnetic flux leakage from the binding leads 66 of the windings 63, with consequent deterioration in the characteristics.

Generally, surface mounting type coils are attached and soldered to a printed circuit board by using an automatic attaching apparatus and a reflow soldering apparatus respectively. As a consequence, when there is considerable variation in the extent and thickness of the solder of the binding leads 66, which are bound to the external terminals 65, the external terminals 65 become nonflat. This causes warping, pitch deviation, and the like in subsequent processing, and some of the external terminals 65 make gaps to a circuit board when the coil is mounted thereon. Further, the terminals 65 deviate from the interconnection patterns on the circuit substrate, causing malfunctions such as connection failure and short-circuiting.

FIG. 12 is an exploded perspective view of another conventional surface mounting type coil comprising a toroidal core. The dotted lines in FIG. 12 represent the configurations of the terminals inside a resin base. Windings 73 comprise a primary winding and a secondary winding, and are wound around a toroidal core 71 and secured to a base 72. As shown by the dotted lines, binding terminals 75*a* are connected inside the base 72 to external terminals 75*b*. The binding leads 76 of the windings 73 are connected to the binding terminals 75*a* by soldering or the like.

This type of surface mounting type coil 73 has a problem of magnetic flux leakage from the binding leads 76 of the windings 73, with consequent deterioration in the characteristics. Further, since the binding terminals 75*a* and the external terminals 75*b* are connected together inside the base 72, the increased dc resistance causes loss. Moreover, since neither of the above examples can be adsorbed by an automatic attaching apparatus, they require a chuck constitution to enable their sides to be held by chucking or the like, and must be handled carefully.

SUMMARY OF THE INVENTION

It is an object of this invention to prevent leakage of magnetic flux from the binding leads of the windings, and to make the external terminals flat without increasing the dc resistance. It is a further object of this invention to provide a surface mounting type coil which can be adsorbed by using an automatic attaching apparatus.

The surface mounting type coil of this invention comprises a coil having windings which are wound around a magnetic core having a hole, a cylindrical magnetic body which is provided around the coil, and a plurality of metal plate terminals which leads of the windings are connected to. The metal plate terminals extend along the outer face of the cylindrical magnetic body from the bottom face to the top face thereof, and are secured to the cylindrical magnetic body in such a manner that their tips are within its thickness. In another arrangement, the metal plate terminals extend along the outer face of the cylindrical magnetic body from a bottom face to the middle of a side face thereof, and are secured to the cylindrical magnetic body in such a manner that their tips on the bottom face are within its thickness. Further, a flat lid is provided over the top face of the cylindrical magnetic body.

DESCRIPTION OF THE PREFERRED EMBODIMENTS

Preferred embodiments of the surface mounting type coil of this invention will be explained with reference to FIG. 1 to FIG. 10.

Figure 1:
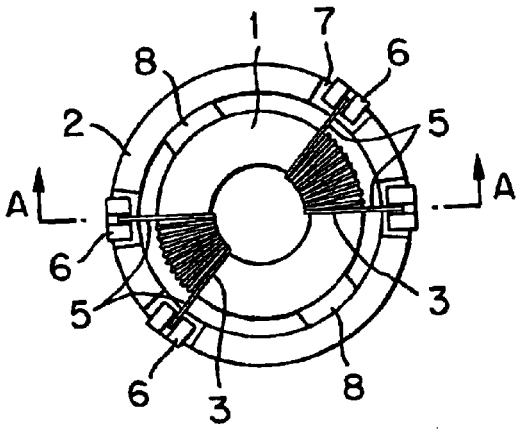
FIG. 1 is a top view of a first embodiment of the surface mounting type coil of this invention.
Figure 2:
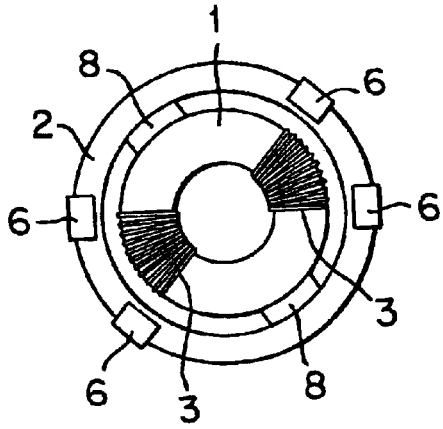
FIG. 2 is a bottom view of FIG. 1.

FIG. 1 shows a first embodiment of the surface mounting type coil according to this invention, and is a top view of a coil comprising a toroidal core. FIG. 2 is a bottom view of the embodiment shown in FIG. 1, and FIG. 3 is a cross-sectional view taken along the line A—A in FIG. 1 when a lid is provided.

Figure 3:
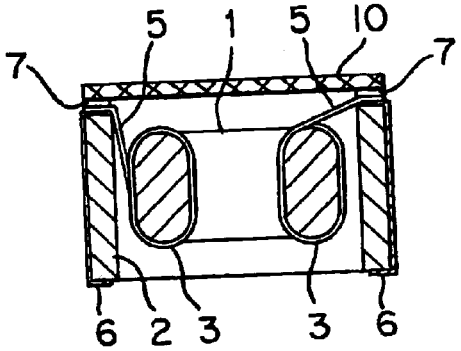
FIG. 3 is a cross-sectional view (along the line A—A) of FIG. 1 when a lid is provided.

In FIGS. 1 to 3, reference code 1 represents the toroidal core, 2 represents a cylindrical magnetic body, and 3 represents primary and secondary windings. The toroidal core 1 is manufactured by sintering magnetic particles of ferrite and the like. The cylindrical magnetic body 2 comprises what is termed a ring core, and is manufactured by sintering magnetic particles of ferrite and the like into a cylindrical shape. Two pairs of concavities 7 are provided in the top face of the cylindrical magnetic body 2, and two pairs of metal plate terminals 6 (explained later) are provided along the outer face. The concavities 7 are step-like, having deep and shallow sections. The metal plate terminals 6 comprise band-like metal pieces, and are provided on the outer face of the cylindrical magnetic body 2 so as to extend in a C-shape along the bottom, side, and top faces. The pair of C-shaped metal plate terminals 6 are cut so that their tips are within the thickness of the cylindrical magnetic body 2 to prevent them from protruding inwards. The metal plate terminals 6 are fixed to the outer face of the cylindrical magnetic body 2 by setting. The ends of the metal plate terminals 6 on the top face of the cylindrical magnetic body 2 are divided into three sections. The center sections of the metal plate terminals 6 extend along the surfaces of the deep section of the concavities 7, and the two outer sections extend along the surfaces of the shallow sections of the concavities 7.

The toroidal core 1, which the windings 3 are wound around, is provided inside the cylindrical magnetic body 2 in such a manner that there is a gap between the side face of the windings 3 and the inner face of the cylindrical magnetic body 2. The cylindrical magnetic body 2 and the side face of the toroidal core 1 are secured together by filling the gap therebetween with adhesive resin or the like, as shown in FIGS. 1 and 2. Binding leads 5 of the windings 3 are inserted into the concavities 7 of the cylindrical magnetic body 2, and connected to one end of the metal plate terminals 6 by soldering or the like. As shown in FIG. 3, a lid comprising thin flat resin has the same cross-sectional shape as the outline of the cylindrical magnetic body 2, and is secured to the top face of the cylindrical magnetic body 2 by using an adhesive or the like. The top face of the lid 10 of the surface mounting type coil of this constitution is adsorbed by using an adsorption nozzle of an automatic attaching apparatus, and the surface mounting type coil is attached to the printed substrate of an electronic device. The metal plate terminals 6 on the bottom side connect to interconnection patterns of the printed substrate.

Figure 4:
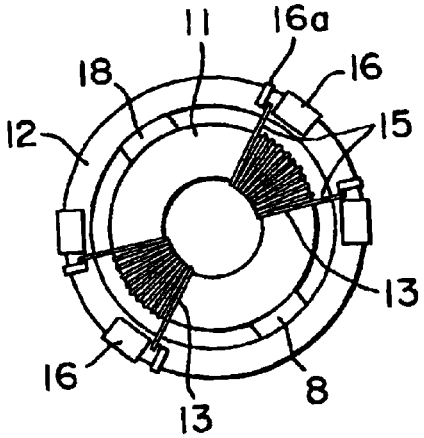
FIG. 4 is a top view of a second embodiment of the surface mounting type coil of this invention.

FIG. 4 is a top view of a second embodiment of the surface mounting type coil comprising a toroidal core according to this invention. A pair of metal plate terminals 16 are C-shaped, and are cut so that their tips are within the thickness of the cylindrical magnetic body 12. In addition, binding sections 16a are provided at the ends of the metal plate terminals 16 which are on the top face of the cylindrical magnetic body 12. A toroidal core 11 is provided concentrically inside the cylindrical magnetic body 12 which comprises the pair of metal plate terminals 16. The toroidal core 11 and the cylindrical magnetic body 12 are secured together by using an adhesive resin or the like. Binding leads 15 of windings 13, which are wound around the toroidal core 11, are bound at the binding sections 16*a* of the metal plate terminals 16 and connected thereto by soldering or the like. A lid comprises thin flat resin, and has the same cross-sectional shape as the outline of the cylindrical magnetic body 12. The lid (not shown in FIG. 4) is secured to the top face of the cylindrical magnetic body 12 by using an adhesive or the like. The top face of the lid of the surface mounting type coil of this constitution is adsorbed by using an adsorption nozzle of an automatic attaching apparatus, and the surface mounting type coil is attached to the printed substrate of an electronic device. The metal plate terminals 16 on the bottom face connect to interconnection patterns of the printed substrate.

Figure 5:
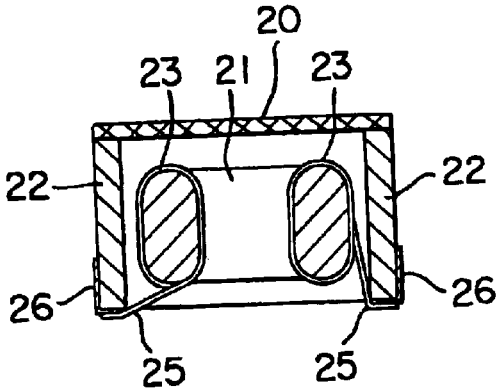
FIG. 5 is a cross-sectional view of a third embodiment of the surface mounting type coil of this invention.

FIG. 5 is a cross-sectional view of a third embodiment of the surface mounting type coil comprising a toroidal core according to this invention. A pair of metal plate terminals 26 are secured to a cylindrical magnetic body 22, and extend along the bottom and side faces thereof in a shape which is L-shaped in cross-section. The metal plate terminals 26 are cut within the thickness of the cylindrical magnetic body 22 so that their tips which are on the bottom side thereof do not protrude inward. The leads 25 of windings which are wound around the toroidal core 21 are extracted along the bottom face of the cylindrical magnetic body 22 and connected to the metal plate terminals 26. A lid 20 comprises thin flat resin, and has the same cross-sectional shape as the outline of the cylindrical magnetic body 22. The lid 20 is secured to the top face of the cylindrical magnetic body 22 by using an adhesive.

Figure 6:
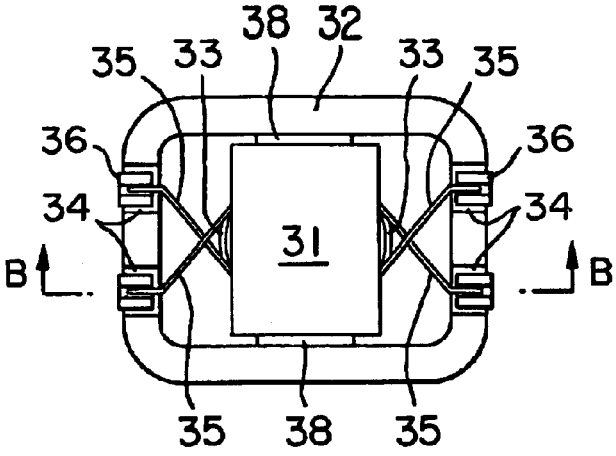
FIG. 6 is a top view of a fourth embodiment of the surface mounting type coil of this invention.
Figure 7:
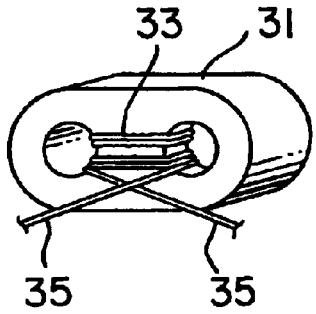
FIG. 7 is a perspective view of a two-hole type core used in FIG. 6.
Figure 8:
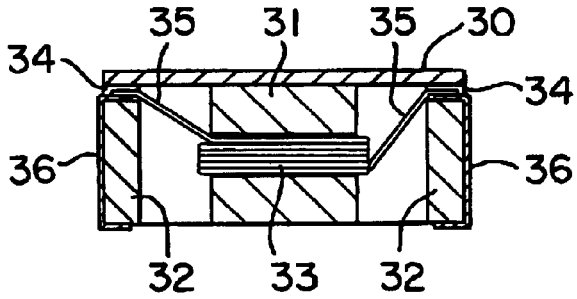
FIG. 8 is a cross-sectional view (along the line B—B) of FIG. 6 when a lid is provided.

FIG. 6 is a top view of a fourth embodiment of the surface mounting type coil of this invention which comprises a two-hole type core. FIG. 7 is a perspective view of a two-hole type core which windings have been wound around. FIG. 8 is a cross-sectional view taken along the line B—B when a lid is provided to the surface mounting type coil shown in FIG. 6.

In FIGS. 6 to 8, reference code 31 represents a two-hole type core, 32 represents a cylindrical magnetic body, and 33 represents primary and secondary windings. The two-hole type core 31 is manufactured by sintering magnetic particles of ferrite and the like. The cylindrical magnetic body 32 comprises what is termed a ring core, and is manufactured by sintering magnetic particles of ferrite and the like into a square-cylindrical shape. Two pairs of concavities 34 are provided in the top face of the cylindrical magnetic body 32, and two pairs of metal plate terminals 36 (explained later) are provided along the outer face.

The concavities 34 are step-like, having deep and shallow sections. The metal plate terminals 36 comprise band-like metal pieces, and are provided on the outer face of the cylindrical magnetic body 32 so as to extend in a C-shape along the bottom, side, and top faces thereof. The pair of C-shaped metal plate terminals 36 are cut so that their tips are within the thickness of the cylindrical magnetic body 32 to prevent them from protruding inwards. The metal plate terminals 36 are fixed to the outer face of the cylindrical magnetic body 32 by setting. The ends of the metal plate terminals 36 on the top face of the cylindrical magnetic body 32 are divided into three sections, the center sections extending along the surfaces of the deep sections of the concavities 34, and the two outer sections extending along the surfaces of the shallow sections of the concavities 34.

The two-hole type core 31, which the windings 33 are wound around, is provided inside the cylindrical magnetic body 32 in such a manner that there is a gap between the side face of the windings 33 and the inner face of the cylindrical magnetic body 32. The cylindrical magnetic body 32 and the side face of the two-hole type core 31 are secured together by filling the gap therebetween with an adhesive resin or the like. Binding leads 35 of the windings 33 are inserted into the concavities 34 in the cylindrical magnetic body 32, and are connected to one end of the metal plate terminals 36 by soldering or the like. A lid 30 comprises thin flat resin, and has the same cross-sectional shape as the outline of the cylindrical magnetic body 32. As shown in FIG. 8, the lid 30 is secured to the top face of the cylindrical magnetic body 32 by using an adhesive or the like. The top face of the lid 30 of the surface mounting type coil of this constitution is adsorbed by using an adsorption nozzle of an automatic attaching apparatus, and the surface mounting type coil is attached to the printed substrate of an electronic device. The metal plate terminals 36 on the bottom side connect to interconnection patterns of the printed substrate.

Figure 9:
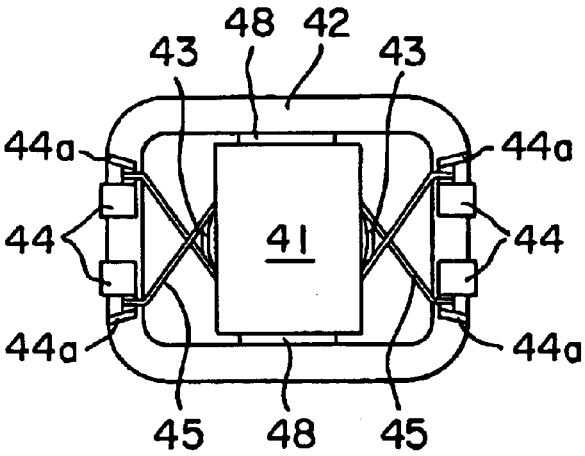
FIG. 9 is a top view of a fifth embodiment of the surface mounting type coil of this invention.

FIG. 9 is a top view of a fifth embodiment of the surface mounting type coil comprising a two-hole type core according to this invention. A pair of C-shaped metal plate terminals 44 are secured to a square-cylindrical magnetic body 42. The metal plate terminals 44 are cut so that their tips are within the thickness of the square-cylindrical magnetic body 42. In addition, binding sections 44*a* are provided at the ends of the metal plate terminals 44 which are on the top face of the square-cylindrical magnetic body 42. A two-hole type core 41 is provided concentrically inside the square-cylindrical magnetic body 42, which comprises the pair of metal plate terminals 44. The two-hole type core 41 and the square-cylindrical magnetic body 42 are secured together by using an adhesive resin 48 or the like. Binding leads 45 of windings 43, which are wound around the two-hole type core 41, are bound at the binding sections 44*a* of the metal plate terminals 44 and connected thereto by soldering or the like. A lid comprises thin flat resin, and has the same cross-sectional shape as the outline of the square-cylindrical magnetic body 42. The lid (not shown in FIG. 9) is secured to the top face of the square-cylindrical magnetic body 42 by using an adhesive or the like. The top face of the lid of the surface mounting type coil of this constitution is adsorbed by using an adsorption nozzle of an automatic attaching apparatus, and the surface mounting type coil is attached to the printed substrate of an electronic device. The metal plate terminals 44 on the bottom face connect to interconnection patterns of the printed substrate.

Figure 10:
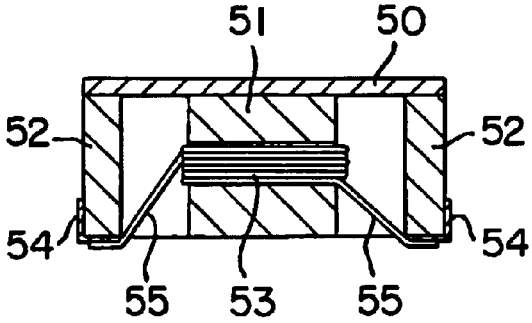
FIG. 10 is a cross-sectional view of a sixth embodiment of the surface mounting type coil of this invention.
Figure 11:
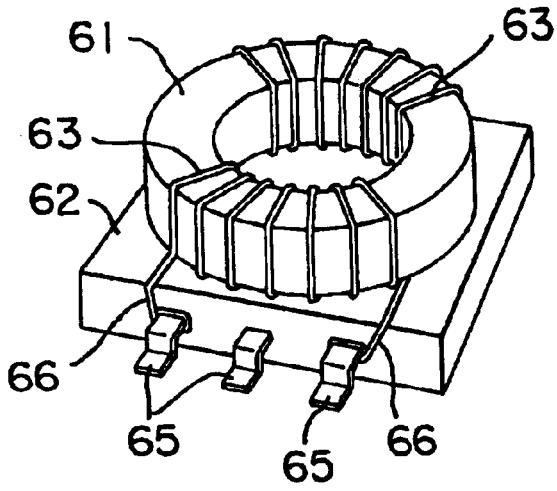
FIG. 11 PRIOR ART
FIG. 11 is a perspective view of a conventional surface mounting type coil.
Figure 12:
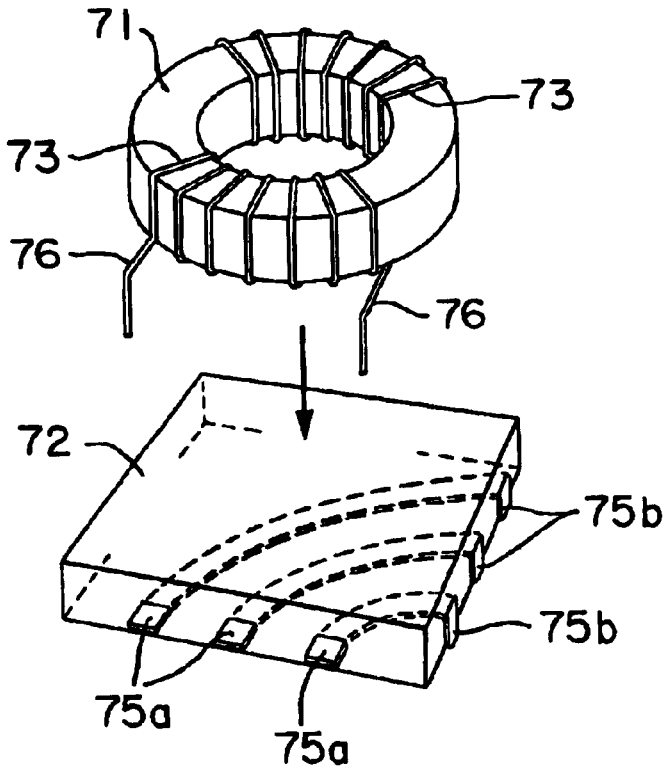
FIG. 12 PRIOR ART
FIG. 12 is an exploded perspective view of another conventional surface mounting type coil.

FIG. 10 is a cross-sectional view of a sixth embodiment of the surface mounting type coil comprising a two-hole type core according to this invention. A pair of metal plate terminals 54 are secured to a square-cylindrical magnetic body 52, and extend along the bottom and side faces thereof in an L-shape. The metal plate terminals 54 are cut within the thickness of the square-cylindrical magnetic body 52 so that their tips which are on the bottom side thereof do not protrude inward. Leads 55 of windings which are wound around the two-hole type core 51 are extracted along the bottom face of the square-cylindrical magnetic body 52 and connected to the metal plate terminals 54. A lid 50 comprises thin flat resin, and has the same cross-sectional shape as the outline of the square-cylindrical magnetic body 52. The lid 50 is secured to the top face of the square-cylindrical magnetic body 52 by using an adhesive or the like.

The surface mounting type coil of this invention is not limited to the embodiments described above. For example, the cylindrical magnetic body may be hollow, and can be provided in a variety of shapes.

As described above, the surface mounting type coil of this invention comprises metal plate terminals provided on a cylindrical magnetic body, which is provided around a toroidal core or a two-hole type core. The metal plate terminals extend along the outer faces of the cylindrical magnetic body from the bottom to the top faces, and are cut so that their tips are within the thickness of the cylindrical magnetic body, thereby preventing them from protruding inwards. Alternatively, the metal plate terminals extend along the outer faces of the cylindrical magnetic body to the bottom and the middle of the side faces, and are cut so that their tips on the side faces are within the thickness of the cylindrical magnetic body, thereby preventing them from protruding inwards. Therefore, the winding leads are shorter than those of a conventional coil. Furthermore, there is less leakage of magnetic flux from the winding leads. The flat lid on top of the cylindrical magnetic body makes it possible to adsorb the top face by using an automatic adsorption apparatus, further improving productivity. Moreover, defects such as floating terminals and positional deviation of the terminals are eliminated by using metal plate terminals, greatly reducing problems with the soldering.

What is claimed is:

1. A surface mounting type coil comprising:

a magnetic core having a hole;

a coil comprising windings which are wound around said magnetic core via said hole;

a cylindrical magnetic body which is provided around the coil;

a plurality of metal plate terminals to which leads of the windings are connected; and the metal plate terminals extending along an outer face of the cylindrical magnetic body from a bottom face to a top face thereof, and being secured to the cylindrical magnetic body in such a manner that tips of the metal plate terminals are within the thickness of the cylindrical magnetic body, wherein the magnetic core is a two-hole type core.

2. A surface mounting type coil comprising:

a magnetic core having a hole;

a coil comprising windings which are wound around said magnetic core via said hole;

a cylindrical magnetic body which is provided around the coil;

a plurality of metal plate terminals to which leads of the windings are connected; and the metal plate terminals extending in a C-shape along an outer face of the cylindrical magnetic body from a bottom face to a top face thereof, and being secured to the cylindrical magnetic body in such a manner that tips of the metal plate terminals are within the thickness of the cylindrical magnetic body wherein the magnetic core is a two-hole type core.

3. A surface mounting type coil comprising:

a magnetic core having at least two holes;

a coil having windings which are wound around said magnetic core via said holes;

a cylindrical magnetic body which is provided around the coil; and a plurality of metal plate terminals to which leads of the windings are connected;

said metal plate terminals extending along an outer face of the cylindrical magnetic body from a bottom face to a top face thereof, and being secured to the cylindrical magnetic body in such a manner that tips of said metal plate terminals are within the thickness of the cylindrical magnetic body.

4. A surface mounting type coil of claim 1, further comprising:

a flat lid of resin which is secured to the top face of said cylindrical magnetic body.

5. A surface mounting type coil of claim 2, further comprising:

a flat lid of resin which is secured to the top face of said cylindrical magnetic body.

6. A surface mounting type coil of claim 3, further comprising:

a flat lid of resin which is secured to the top face of said cylindrical magnetic body.

* * * * *